US006857549B1

(12) United States Patent
Chen

(10) Patent No.: US 6,857,549 B1
(45) Date of Patent: Feb. 22, 2005

(54) NAIL DRIVING GUN WITH A SHOCK-ABSORBING MEMBER

(75) Inventor: Hong-Fei Chen, Taichung (TW)

(73) Assignee: Navtor Technology Corporation (TW)

( * ) Notice: Subject to any disclaimer, the term of this patent is extended or adjusted under 35 U.S.C. 154(b) by 0 days.

(21) Appl. No.: 10/719,126

(22) Filed: Nov. 21, 2003

(51) Int. Cl.[7] ..... B25C 1/06

(52) U.S. Cl. ..... 227/131; 227/129; 227/132; 227/134; 310/14

(58) Field of Search ..... 227/120, 129, 227/131, 132, 134; 310/14, 23, 30, 34

(56) References Cited

U.S. PATENT DOCUMENTS 3,179,866 A * 4/1965 Doyle et al. ..... 318/125
3,345,546 A * 10/1967 Beltramo ..... 318/132
3,766,455 A * 10/1973 Zakrewsky et al. ..... 318/135
4,183,453 A * 1/1980 Barrett et al. ..... 227/131
4,515,303 A * 5/1985 Schadlich et al. ..... 227/131
4,573,621 A * 3/1986 Merkator et al. ..... 227/8
6,364,193 B1 * 4/2002 Tsai ..... 227/131

* cited by examiner

*Primary Examiner*—Eugene Kim
*Assistant Examiner*—Nathaniel Chukwurah
(74) *Attorney, Agent, or Firm*—Ostrolenk, Faber, Gerb & Soffen, LLP

(57) ABSTRACT

A nail driving gun includes a gun housing, a solenoid mounted in the gun housing and including a coil member and a magnetic core which are magnetically attracted to each other in such a manner that the magnetic core is movable in a frontward direction and the coil member is movable in a rearward direction opposite to the frontward direction when the solenoid is actuated, a striking pin extending from the magnetic core so as to be movable together therewith and so as to expel a nail upon actuation of the solenoid, an urging member for restoring the magnetic core to a normal position, and a shock-absorbing member resiliently abutting against the coil member so as to provide a shock-absorbing effect on the nail driving gun.

2 Claims, 5 Drawing Sheets

NAIL DRIVING GUN WITH A SHOCK-ABSORBING MEMBER

BACKGROUND OF THE INVENTION

1. Field of the Invention

This invention relates to a nail driving gun, more particularly to a nail driving gun with a shock-absorbing member.

2. Description of the Related Art

FIGS. 1 and 2 illustrate a conventional nail driving gun that includes a gun housing 1 defining a nail discharging passage 21, a nail cartridge 2 connected to the gun housing 1 for supplying nails (not shown) one at a time into the nail discharging passage 21, and a solenoid 3 mounted in the gun housing 1 and including a coil member 31 which is fixed to the gun housing 1, and a magnetic core 32 which is magnetically attracted by the coil member 31 to move into the latter when the solenoid 3 is actuated and a current from a power source (not shown) passes through the coil member 31. A striking pin 322 extends from the magnetic core 32 into the nail discharging passage 21 for expelling the nail out of the nail discharging passage 21 upon actuation of the solenoid 3. An urging member 332 urges the magnetic core 32 so as to restore the latter to its normal position once the solenoid 3 is deactivated. The solenoid 3 is activated by pulling a trigger 41 to connect electrically the coil member 31 to the power source through a control circuit 42.

The conventional nail driving gun is disadvantageous in that since the coil member 31 and the magnetic core 32 are magnetically attracted to each other upon actuation of the solenoid 3, and since the coil member 31 is fixed to the gun housing 1, a pulling force ($F_N$) resulting from the attraction is formed and is applied to the coil member 31 upon actuation of the solenoid 3, which results in a shock on the gun housing 1, which, in turn, results in deviation of the nail expelled from the nail driving gun and unstable and uncomfortable operation of the nail driving gun.

SUMMARY OF THE INVENTION

Therefore, the object of the present invention is to provide a nail driving gun that is capable of overcoming the aforesaid drawback of the prior art.

According to the present invention, there is provided a nail driving gun that comprises: a gun housing having a front open end that defines a nail-discharging passage extending in a longitudinal direction; a solenoid mounted in the gun housing and adapted to be actuated upon receiving a current from a power source, the solenoid including a coil member and a magnetic core which are aligned in the longitudinal direction and which are magnetically attracted to each other in such a manner that the magnetic core is movable in a frontward direction along the longitudinal direction and the coil member is movable in a rearward direction opposite to the frontward direction when the solenoid is actuated, the magnetic core being disposed rearwardly of the coil member and having a front end; a striking pin extending from the front end of the magnetic core through the coil member and into the nail discharging passage so as to be movable together with the magnetic core and so as to be adapted to expel a nail from the nail discharging passage; an urging member mounted in the gun housing for restoring the magnetic core to a normal position after expelling the nail; and a shock-absorbing member mounted in the gun housing and disposed rearwardly of and resiliently abutting against the coil member so as to provide a shock-absorbing effect on the nail driving gun when the coil member is magnetically drawn by the magnetic core to move in the rearward direction.

BRIEF DESCRIPTION OF THE DRAWINGS

In drawings which illustrate an embodiment of the invention.

DETAILED DESCRIPTION OF THE PREFERRED EMBODIMENT

Figure 1:
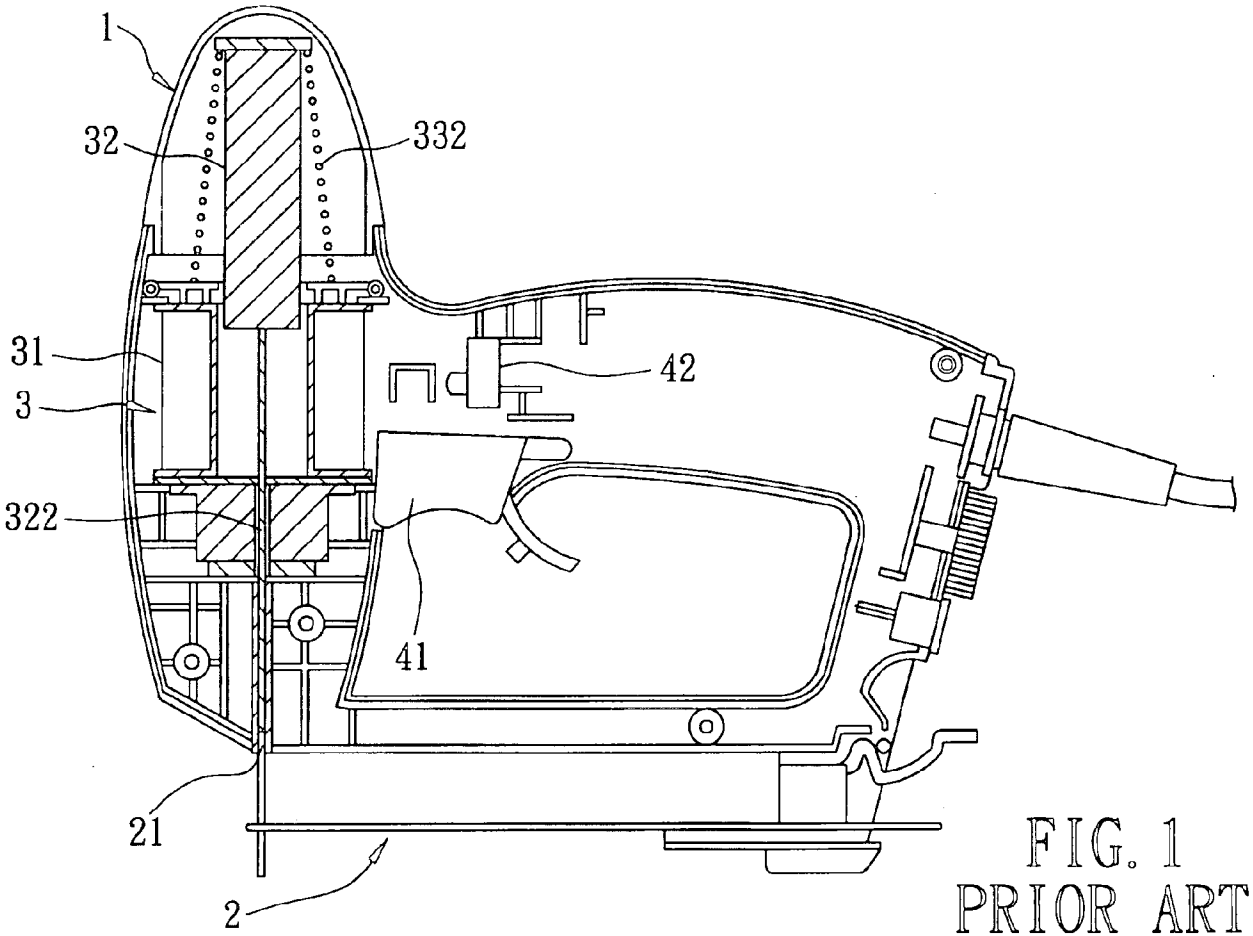
FIG. 1 PRIOR ART
FIG. 1 is a fragmentary view of a conventional nail driving gun.
Figure 2:
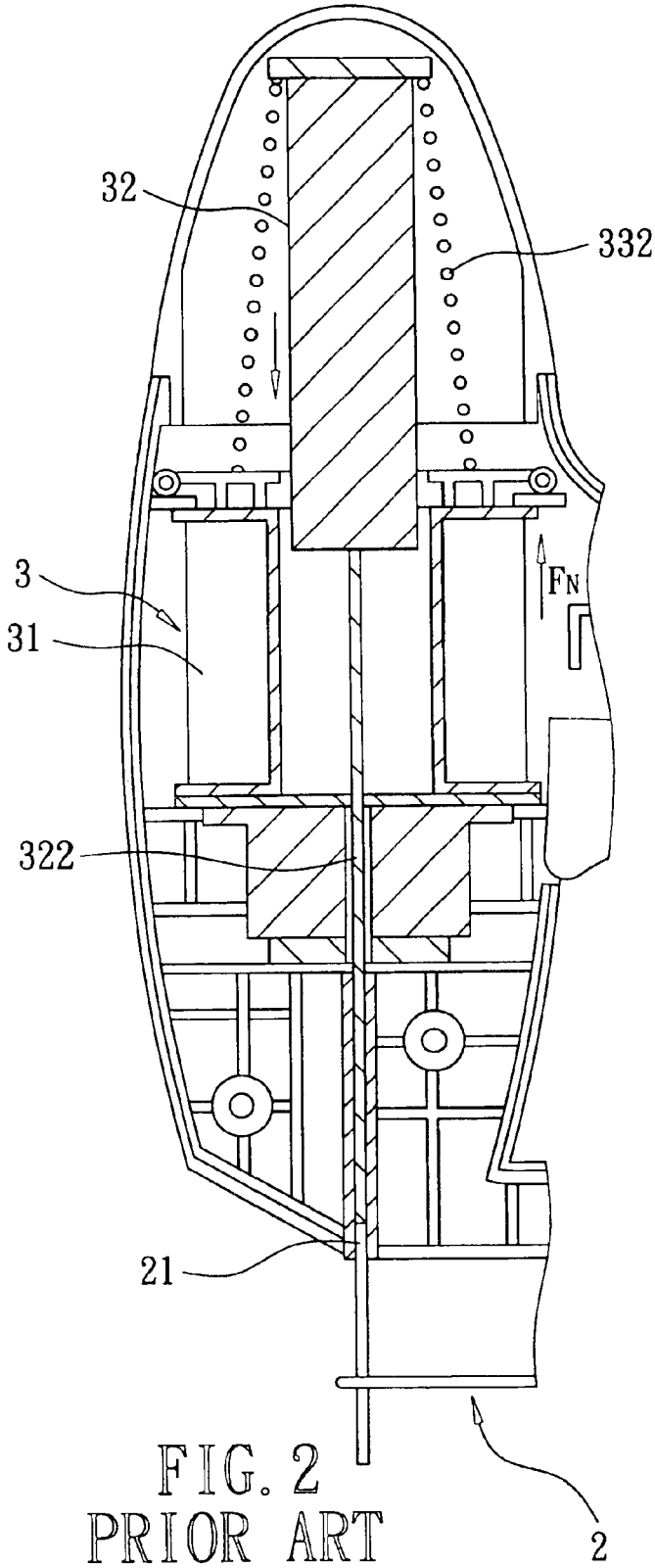
FIG. 2 PRIOR ART
FIG. 2 is a fragmentary view to illustrate how a magnetic core and a coil member of a solenoid of the nail driving gun of FIG. 1 are attracted to each other when the solenoid is actuated.
Figure 3:
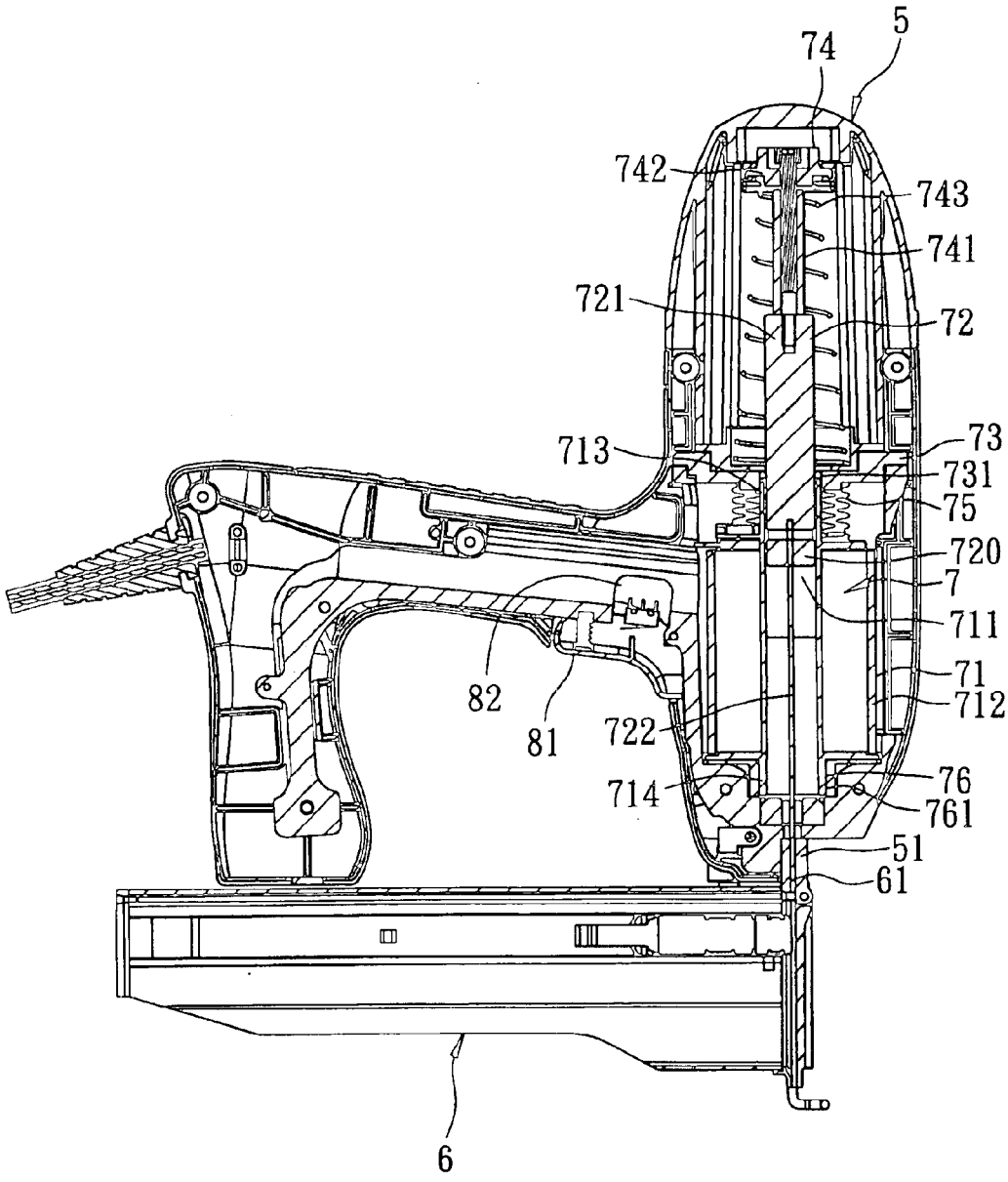
FIG. 3 is a fragmentary view of a nail driving gun embodying this invention.
Figure 4:
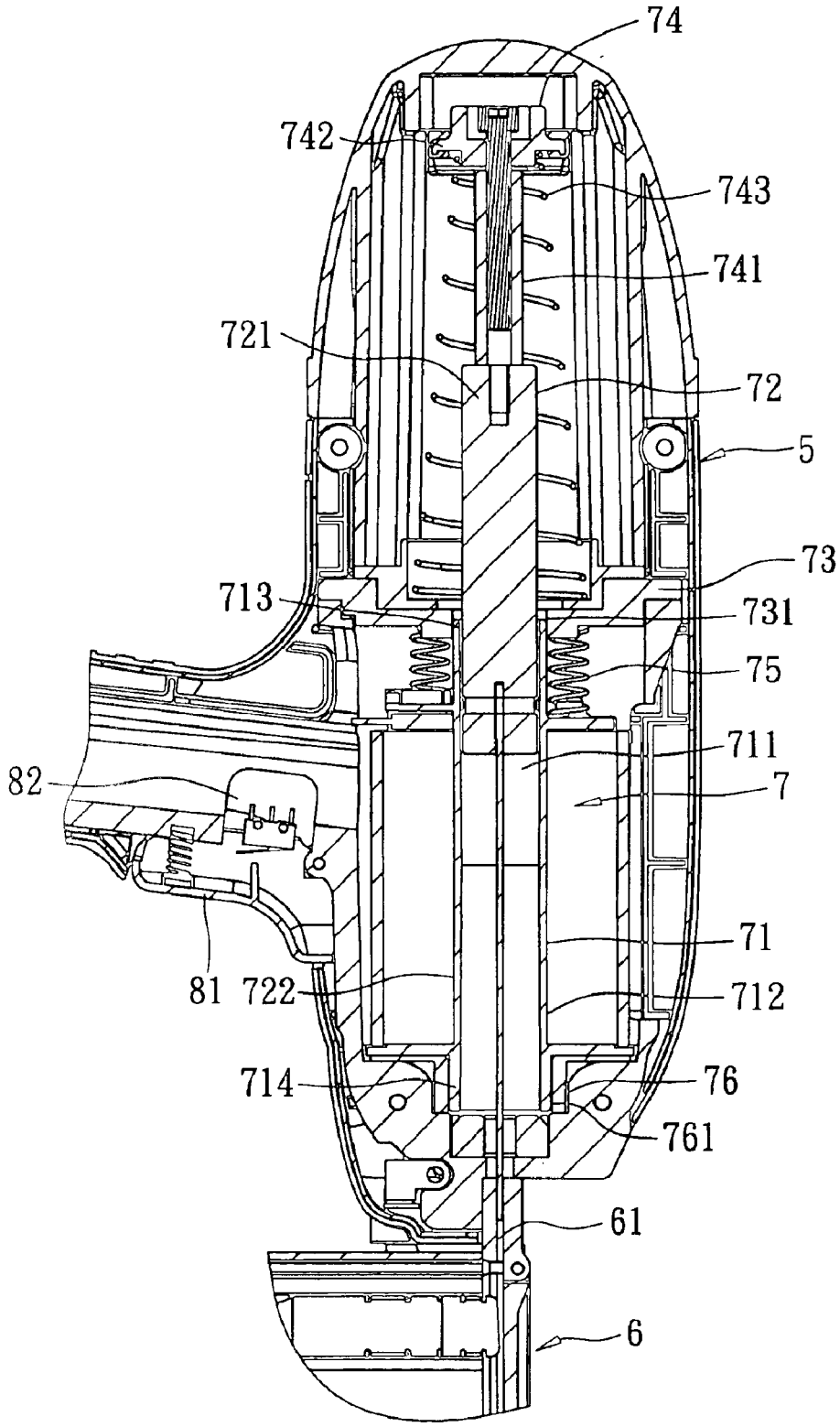
FIGS. 4 and 5 are fragmentary views to illustrate how a coil member and a magnetic core of a solenoid of the nail driving gun of this invention are attracted to each other to move in opposite directions and how a shock-absorbing member engages the coil member.
Figure 5:
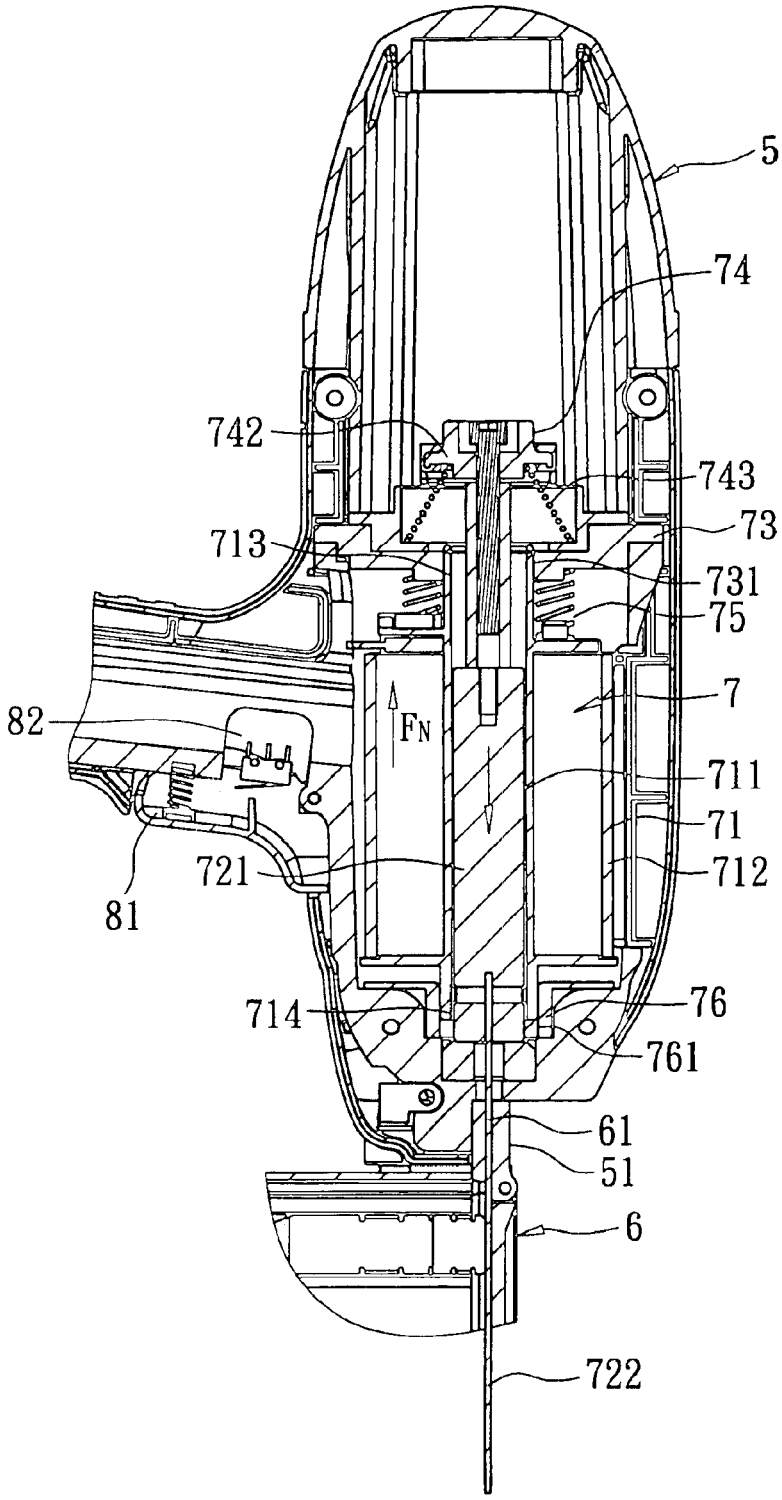

FIGS. 3 to 5 illustrate the preferred embodiment of a nail driving gun according to this invention. The nail driving gun includes: a gun housing 5 having a front open end 51 that defines a nail-discharging passage 61 extending in a longitudinal direction; a nail cartridge 6 connected to the front end 51 of the gun housing 5 so as to supply nails (not shown) one at a time to the nail-discharging passage 61; a solenoid 7 mounted in the gun housing 5 and adapted to be actuated upon receiving a current from a power source (not shown), the solenoid 7 including a coil member 71 and a magnetic core 72 which are aligned in the longitudinal direction and which are magnetically attracted to each other in such a manner that the magnetic core 72 is movable in a frontward direction (see FIG. 5) along the longitudinal direction and the coil member 71 is movable in a rearward direction opposite to the frontward direction when the solenoid 7 is actuated, the magnetic core 72 being disposed rearwardly of the coil member 71 and having a front end 720; a striking pin 722 extending from the front end 720 of the magnetic core 72 through the coil member 71 and into the nail discharging passage 61 so as to be movable together with the magnetic core 72 and so as to expel the nail from the nail discharging passage 61; an urging member 743 mounted in the gun housing 5 for restoring the magnetic core 72 to a normal position after expelling the nail; and a shock-absorbing member 75 mounted in the gun housing 5 and disposed rearwardly of and resiliently abutting against the coil member 71 so as to provide a shock-absorbing effect on the nail driving gun when the coil member 71 is magnetically drawn by the magnetic core 72 (see FIG. 5, a pulling force $F_N$ is applied to the coil member 71) to move in the rearward direction upon actuation of the solenoid 7. The pulling force $F_N$ is dampened by the shock-absorbing member 75 before being transmitted to the gun housing 5.

The gun housing 5 defines an inner space therein, and is formed with front and rear guiding seats 76, 73 that are disposed in the inner space between the urging member 743 and the front open end 51 of the gun housing 5 and that respectively define a front guiding channel 761 adjacent to the front open end 51, and a rear guiding channel 731 adjacent to the urging member 743. The front and rear guiding channels 761, 731 and the nail discharging passage

61 are aligned in the longitudinal direction. The coil member 71 defines a magnetic core passage 711 for extension of the magnetic core 72 therein, and has an intermediate section 712, a front end section 714 reducing from the intermediate section 712 and extending into the front guiding channel 761, and a rear end section 713 opposite to the front end section 714, reducing from the intermediate section 712, and extending into the rear guiding channel 731.

The shock-absorbing member 75 can be a coil spring(s), a rubber, or a sponge, and the like. In this embodiment the shock-absorbing member 75 includes a plurality of coil springs that are disposed between and that abuts against the rear guiding seat 73 and the intermediate section 712 of the coil member 71.

A spring-holding member 74 extends rearwardly from the magnetic core 72. The urging member 743 is in the form of a coil spring that is sleeved around a portion 721 of the magnetic core 72 and a portion 741 of the spring-holding member 74, and that abuts against an end flange 742 of the spring-holding member 74 and the rear guiding seat 73 of the gun housing The solenoid 7 is activated by pulling a trigger 81 to connect electrically the coil member 71 to the power source through a control circuit 82 in a known manner.

With the inclusion of the shock-absorbing member 75 in the nail driving gun of this invention, the counter force, i.e., the pulling force ($F_N$), resulting from actuation of the solenoid 7 can be dampened, which can provide a more comfortable, stable, and precise operation of the nail driving gun of this invention as compared to the conventional nail driving gun.

With the invention thus explained, it is apparent that various modifications and variations can be made without departing from the spirit of the present invention.

I claim:

1. A nail driving gun comprising:

a gun housing having a front open end that defines a nail-discharging passage extending in a longitudinal direction;

a solenoid mounted in said gun housing and adapted to be actuated upon receiving a current from a power source, said solenoid including a coil member and a magnetic core which are aligned in said longitudinal direction and which are magnetically attracted to each other in such a manner that said magnetic core is movable in a frontward direction along said longitudinal direction and said coil member is movable in a rearward direction opposite to said frontward direction when said solenoid is actuated, said magnetic core being disposed rearwardly of said coil member and having a front end;

a striking pin extending from said front end of said magnetic core through said coil member and into said nail discharging passage so as to be movable together with said magnetic core and so as to adapted to expel a nail from said nail discharging passage;

an urging member mounted in said gun housing for restoring said magnetic core to a normal position after expelling the nail; and a shock-absorbing member mounted in said gun housing and disposed rearwardly of and resiliently abutting against said coil member so as to provide a shock-absorbing effect on said nail driving gun when said coil member is magnetically drawn by said magnetic core to move in said rearward direction.

2. The nail driving gun of claim 1, wherein said gun housing defines an inner space therein, and is formed with front and rear guiding seats that are disposed in said inner space between said urging member and said front open end of said gun housing and that respectively define a front guiding channel adjacent to said front open end, and a rear guiding channel adjacent to said urging member, said front and rear guiding channels and said nail discharging passage being aligned in said longitudinal direction, said coil member defining a magnetic core passage for extension of said magnetic core therein, and having an intermediate section, a front end section reducing from said intermediate section and extending into said front guiding channel, and a rear end section opposite to said front end section, reducing from said intermediate section, and extending into said rear guiding channel, said shock-absorbing member being in the form of a coil spring that is disposed between and that abuts against said rear guiding seat and said intermediate section of said coil member.

* * * * *